United States Patent [19]

Carrera

[11] Patent Number: 4,917,310

[45] Date of Patent: Apr. 17, 1990

[54] PROCESSING APPARATUS FOR SOLID REFUSE

[75] Inventor: Pietro Carrera, Rocca di Papa, Italy

[73] Assignee: Sorain Cecchini Recovery, Incorporated, Fairfax, Va.

[21] Appl. No.: 315,849

[22] Filed: Feb. 27, 1989

[51] Int. Cl.[4] ..... B02C 18/22

[52] U.S. Cl. ..... 241/32; 241/81; 241/82; 241/190; 241/243; 241/DIG. 38

[58] Field of Search ..... 241/81, 190, 82, 186.2, 241/186.3, 166, 167, 37, 32, 189 R, 243, 222, 224, DIG. 38, 287, 288, 289, 290

[56] References Cited

U.S. PATENT DOCUMENTS

| | | | |
|---|---|---|---|
| 1,374,207 | 4/1921 | Jacobson | 241/82 X |
| 1,647,730 | 11/1927 | Hartman | 241/82 |
| 3,332,629 | 7/1967 | Miller | 241/82 X |
| 3,610,543 | 10/1971 | Jensen | 241/190 X |
| 3,703,970 | 11/1972 | Benson | 241/243 X |
| 3,934,826 | 1/1976 | Graveman | 241/81 |
| 4,049,206 | 9/1977 | Konig et al. | 241/190 X |
| 4,168,035 | 9/1979 | Palm et al. | 241/81 |

FOREIGN PATENT DOCUMENTS

| | | | |
|---|---|---|---|
| 1037174 | 9/1953 | France | 241/243 |

*Primary Examiner*—Mark Rosenbaum

*Attorney, Agent, or Firm*—Cushman, Darby & Cushman

[57] ABSTRACT

A processing apparatus for solid waste including a rotor with a plurality of blades mounted thereon for shredding solid waste in corporation with a number of counterblades. A prescreening system is provided adjacent the inlet to the shredding elements so as to allow small abrasive items to be removed from the waste prior to shredding. A flexible cleaning system is provided for cleaning waste wrapped about the rotor between the blades. Further, a system is provided for preventing nonshreddable materials from jamming the rotor blade/counterblade system and for diverting such nonshreddable materials to a designated hopper.

17 Claims, 4 Drawing Sheets

PROCESSING APPARATUS FOR SOLID REFUSE

BACKGROUND OF THE INVENTION

1. Field of the Invention

The present invention relates to an apparatus for processing solid refuse and, in particular, to a device for shredding solid refuse that employs a shaft equipped with radial blades.

2. Description of the related Art

Ecological problems have become a primary concern in modern society. One of the major problems is the disposal of solid waste which, of any kind, can create problems with the soil and water stratums as well as air pollution when the solid waste is incinerated. Indeed, solid waste management is of critical importance in view of the incredible amount of solid waste generated daily, particularly in large metropolitan areas. However, safe, reliable, and effective methods of dealing with solid waste have yet to be developed.

To date, the trend have been to dump solid waste in landfills. However, in addition to the environmental and health concerns of landfills, landfill capacity is a primary problem as available landfills are rapidly being exhausted as a result of the high volume of solid waste generated. Because the capacity of landfills is being expended so rapidly, several efforts have been made to reduce waste volume before dumping.

For example, there has been a great deal of interest in municipal and commercial solid waste processing through recycling, in marketable material recovery, as well as in the preparation of RDF (Refuse Derived Fuel) for energy production. However, in order to implement the above waste reduction practices, it is necessary to prepare the waste by clearing plastic and paper bags used to wrap the waste and by reducing the volume of oversized items such as pieces of cardboard and wood which can generate clogs in a processing line.

The removal of wrappings and reduction in size of oversized items has been attempted with varying kinds of crushing equipment. In fact, many different kinds of crushing equipment have been used and manufactured worldwide in order to perform waste volume reduction and/or bag breaking. Unfortunately, to date these devices have only been of limited usefulness and thus have not met their original expectations.

Traditional high speed hammer mills have been frequently used and while they can solve the problem of breaking bags and reducing volume, they have created a series of other problems. For example, there is a danger of explosion due to formation of a milieu stowed with paper fibers and inflammables with the contemporaneous generation of sparks by the friction of metallic parts. In addition, there are high operation and maintenance costs due to the high energy consumption and considerable abrasion of the internal parts of the system. Further, when the equipment is used upstream of a recycling process, the mutual contamination of the materials which define the waste flow is an additional problem.

Some of the equipment for processing solid refuse have been known for a number of years. However, in spite of attempts to overcome the above disadvantages including the application of low speed equipment, in most cases the expected results have not been achieved especially in terms of hourly throughput and problems created by unshreddable items present in the waste flow. One system is shown in U.S. Pat. No. 4,039,150. A second system is shown in Japanese Patent No. 5183265 and a third system is shown in U.S. Pat. No. 4,489,896. All of these systems are based on the same principle which is represented by a rotating drum equipped with projecting blades which penetrate into a series of fixed, comb-like counterblades with different shapes.

Specifically, the main feature of the system described in U.S. Pat. No. '150 is represented by an input material feeding system and a compressing system towards the shredding stage. Therefore, this device is particularly suited for shredding bulky items. However, the shredding stage has considerable limits. More particularly, while the machine can reject hard, unshreddable items, it can not separate such items from the remaining mass flow. In addition, while the rotating drum contrast anvil operates by virtue of its own weight and inertial force, the drum carrying the radial blades can not be low speed since it requires a considerably high impact velocity between the drum blades and the anvil so as to prevent the anvil from opening and staying open. Thus, the required impact velocity can only be reached with a medium high speed.

A further problem with the system described in U.S. Pat. No. '150 is that all the materials to be processed pass through the blades and counterblades. Therefore, abrasive components present in the material flow such as glass, grit, stones, etc. can quickly wear the radial blades and the anvil. An even further problem is with the infeed system. Indeed, this system can cause considerable problems when the materials to be fed are municipal solid waste since oversized rags, ropes, films, pantyhose, etc. tend to twist around the rotating device and cause the same to stop rotating after a relatively short time.

The Japanese patent shows an apparatus for processing a particular kind of waste, not municipal solid waste. This device is adapted to shred the material between teeth mounted on a rotating drum and a series of shredding blades which are kept in a desired position by a pneumatic spring. The shredded material is passed on a grate which accepts shredded material while it carries unshreddable items forward to a special outlet by the thrust of the rotating teeth. As is apparent, then, this system can only work with very peculiar waste because in the case of municipal solid waste which consists of mixed materials of many kinds such as plastic, rags, paper, etc. the ground material would not pass through any grate but would be dragged towards the rejection outlet together with the unshreddable items. The problems of this dragging effect are readily apparent. Even if this machine may possibly, with special modifications, process some kinds of municipal solid waste, it would present, in any case, several problems. Specifically, the rotating drum can not be a low speed drum since a centrifugal force is required to allow the shredded material to pass through the grate and the rejected material to pass through the discharge outlet. Further, the entire waste flow passes through the drum blade shredding blade system. Thus the entire abrasive material fraction is passed therebetween and can cause considerable wear on these members and the grate below.

U.S. Pat. No. '896 provides a machine suited for any kind of waste with a slow rotating operation and also with the possibility of discharging unshredded waste. However, this system has limits as well. In particular, it has a very restricted hourly capacity due to unshreddable item expulsion which is performed by rotor catch and a reversing of the rotor. A great amount of time lost because this cycle catch, reversing and resetting. Second, the rotor speed must be very low so that the device can stop when jammed without causing damage to the mechanical members. Finally, all the material to be processed must pass through the shredding teeth and thus abrasive material which is present in the flow can quickly wear the contact elements.

SUMMARY OF THE INVENTION

It is an object of the present invention to provide a device for processing solid refuse which improves the devices set forth above by providing great reliability and low operation cost for large throughput plants. More particularly, the present invention relates to a rotating shaft or drum type processing device equipped with radial blades which is mounted in a housing wherein contrast knives are kept in the proper position by an oleodynamic spring system. With such a system, any kind of waste can be comminuted, either municipal, commercial or industrial. Further, small as well as large hourly throughputs of waste can be processed since, although the machine is a low speed machine which reduces the likelihood of explosion, it is configured so that upon encountering an unshredded item it does not stop and reverse the rotor but rather effects the expulsion of such unshreddable items from the system without ceasing flow. In accordance with the present invention, rejection of unshredded items occurs by means of a mobile wall which temporarily diverts the outlet material flow with the aid of the rotor in a different direction than the shredded waste. This not only avoids time lost for reversing and overloads on mechanical members caused by stoppage of rotation of knives against a fixed nonshreddable item, it also means that it is possible to select a more appropriate rotation speed without being influenced by other factors.

The present invention further provides a configuration for pre-screening refuse within the machine prior to shredding. In this manner, abrasive components such as glass, grit, stone, etc. can fall under the influence of their own weight without being dragged into the shredding blade system and thus the maintenance costs of the device are reduced as well and a higher device capacity can be provided.

Further, the material infeed system of the invention combined with the rotational direction and disposition of cutting blades on the drum enable the apparatus of the invention to distribute material within the processing system, balancing stresses on the blades and thus reducing power required for rotation. Specifically, the material is conveyed under its own weight towards the base of blades mounted on the drum and thus power for rotating the drum is reduced. Further, the blades are disposed on the drum so that material breaking occurs progressively as for example with a scissors cutting. Thus, the blades provided in accordance with the present invention are mounted to the rotor as multiple spirals or a helix which reduces the force required for this operation and hence the power needed for rotating the drum. Even further, the manner in which the blades are coupled makes possible a decrease in axial thrust on the drum as well as on contrast blades thereby reducing stresses on mechanical members and accordingly reducing maintenance costs.

Rotor self cleaning is further provided in accordance with the present invention without rotor axis abrasion. More particularly, a flexible contrast system is provided for cleaning materials from the rotor which tend to stick thereto and/or wind thereabout. The flexible contrast system avoids drum abrasion caused by insertion of abrasive materials between the drum and the contrast saddles. This means reductions in maintenance costs as well.

Finally, due to the position of the contrast knives or counterblades, the discharge of shredded material is considerably facilitated due to a wide free fall space. Therefore, it is possible to avoid partial entrainment inside the shredding process and thus even more power can be saved.

Other objects, features, and characteristics of the present invention, as well as the methods of operation and functions of the related elements of the structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENT

Figure 1:
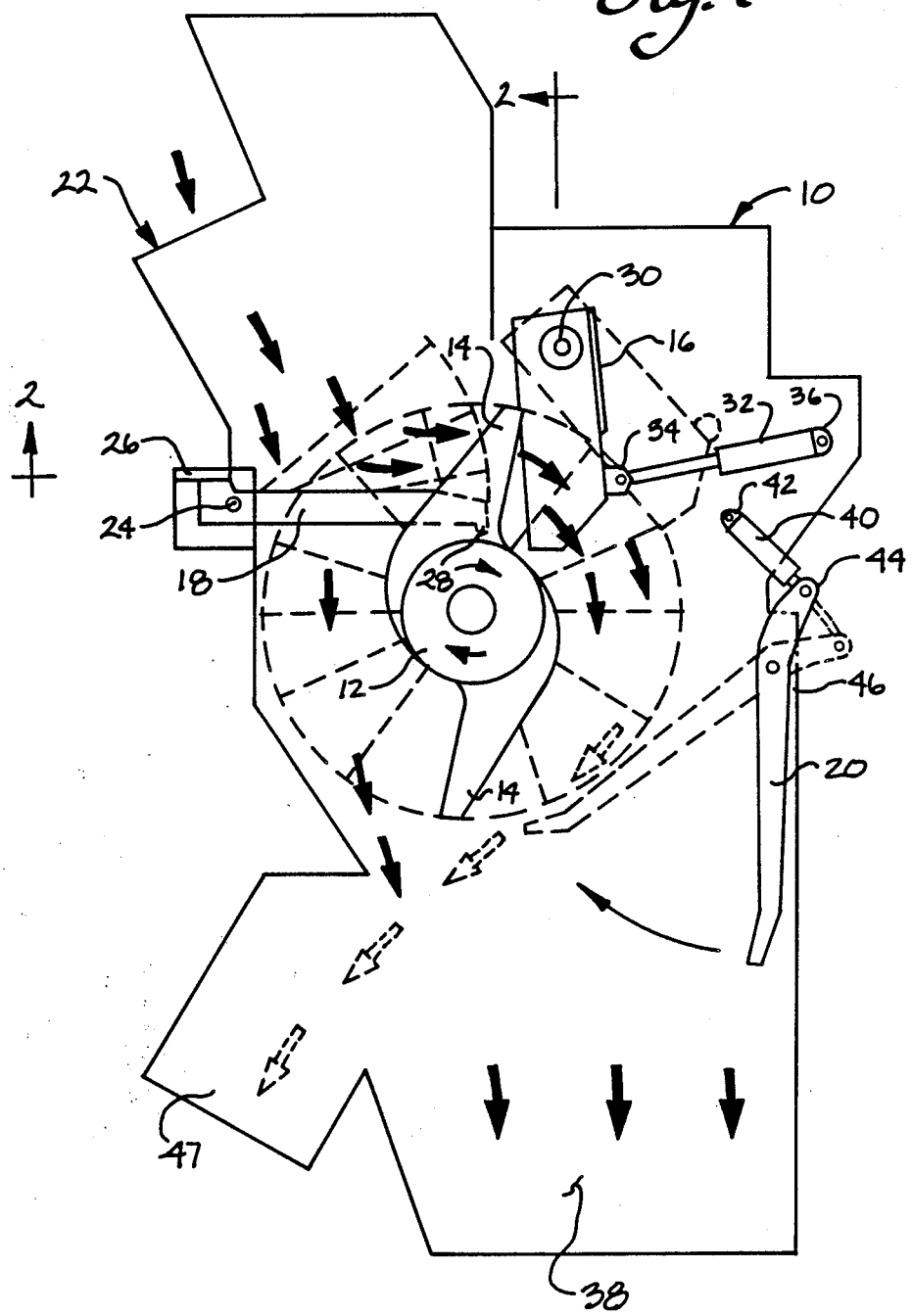
FIG. 1 is a schematic vertical section of an apparatus provided in accordance with the present invention.

The apparatus provided in accordance with the present invention, as shown in particular in FIG. 1, includes a large size housing 10 which contains the complete shredding unit. The shredding unit includes a rotor 12, blades 14, counterblades 16, pre-screening bars or cross-members 18 and a flow diverter 20.

Housing 10 includes an upper, large size feed opening 22 for example 2.6 meters by 1.5 meters for receiving waste to be shredded. The waste passed through this opening 22 falls down onto pre-screening bars or cross-members 18 which are disposed at spaced locations along the longitudinal axis of rotor 12, each having a longitudinal axis substantially perpendicular to a vertical plane through the longitudinal axis of the rotor 12. Accordingly, the pre-screening bars 18 define a comb-like configuration upon which the solid waste initially falls. Small mixed materials mostly consisting of glass, grit, stones and the like will fall between the pre-screening bars 18 thereby minimizing the likelihood that such material will wear down the rotor blades 14 and/or counterblades 16 as refuse is shredded therebetween.

The pre-screening process is enhanced by feeding material to the housing from above the rotor on the opposite side of the rotor with respect to the counterblades. Thus, the feed location is the opposite of the location of material receipt in other prior art devices.

Continuous cleaning of the rotor is of course important and has been provided in some forms in prior machines. However, all the previously provided rotor cleaning devices have been provided by fixed saddles which wind around a part of the rotor. While these devices can achieve the cleaning object, they can also cause great wear problems on the rotor which is the most important portion of the machine and thus can result in considerable maintenance costs. The hard wear on the rotor is caused by the insertion between the fixed saddles and the rotor of abrasive materials such as glass powder, grit, etc. which are prevalent in waste.

In accordance with the present invention, each of the pre-screening bars 18 is pivotally mounted to the housing as shown at 24 and is limited in its downward pivotal movement by means of a beam 26 so that the forward hook-like scraping end 28 thereof is disposed between blades 14 and can scrape materials which have become twisted or wrapped about the rotor 12, between blades 14. If, however, large objects have become caught between the blades 14 of the rotor 12 and are not easily removed therefrom, the same will urge the respective pre-screening bar(s) 18 upwardly about pivot point 24 so that the system will not be jammed by such materials. As is apparent, each of the pre-screening bars 18 can pivot or rotate upwardly independently of the remaining bars when non-removable waste disposed between the blades 14 of the rotor 12 contacts the same.

The pre-screening bars are preferably formed from robust 30 millimeter thick plates and wear-proof steel and are kept in position by beam 26, as was discussed above, which spaces the bars longitudinally as well thereby avoiding their bumping into blades and leaning against the rotor.

In providing such bars 18, it is necessary to carefully study the bars' weight taking into consideration that they support the weight of inlet waste and also considering the position of the hook on the rotor. In fact, there is a danger that the hook will be lifted upwardly too easily by materials wrapped about the rotor rather than removing the same from the rotor. In order to minimize the likelihood of this problem, the hook of the bar has been placed a little beyond the rotor axis center line as shown in FIG. 1 so that the forces exerted on it are predominantly horizontal with only a slight vertical component, counterbalanced, however, by its own weight as well as the weight of waste material fed through the inlet.

Feeding the machine from above the rotor on the side opposite the counter blades provides a second advantage which is the uniform waste distribution at the cutting points where the combined action of blades and counterblades occurs. In fact, unlike the prior systems discussed above, the inlet material is not taken directly up between the blades 14 and the counterblades 16 but is conveyed upwardly and rotated approximately 90° together with the rotor 12 and blades 14 before coming up against counterblades 16. When stacks of waste are fed in a machine on the center or on the cutting side of the rotor as occurs with prior feeding systems, the material is ordinarily immediately compressed between the blades and counterblades. This generates considerable cutting stress. On the contrary, with the system of the invention due to the lifting coupled with the helical blade configuration on the rotor, as shown for example in FIG. 4, the waste will tend to tumble filling up adjacent empty areas of the rotor 12. More particularly, since the waste is infed to the side opposite the cutting side and input waste is sequentially lifted by the helically mounted blades 14 which penetrate between the pre-sifting bars 18, the waste tends to spread over the blades' base due to its own gravity force. Thus, the waste is naturally spread longitudinally of the rotor 12 prior to cooperation with counterblades 16 and cutting performance can be distributed about 360°. This distribution allows a regular machine operation as well as a reduction of the equipment's working arm. Thus a reduction of power consumption peaks is possible which not only reduces stress on the mechanical members but decreases the likelihood that an otherwise shreddable item will be discarded as unshreddable simply due to the bulk of materials disposed between one portion of the rotor and the counterblades.

Figure 2:
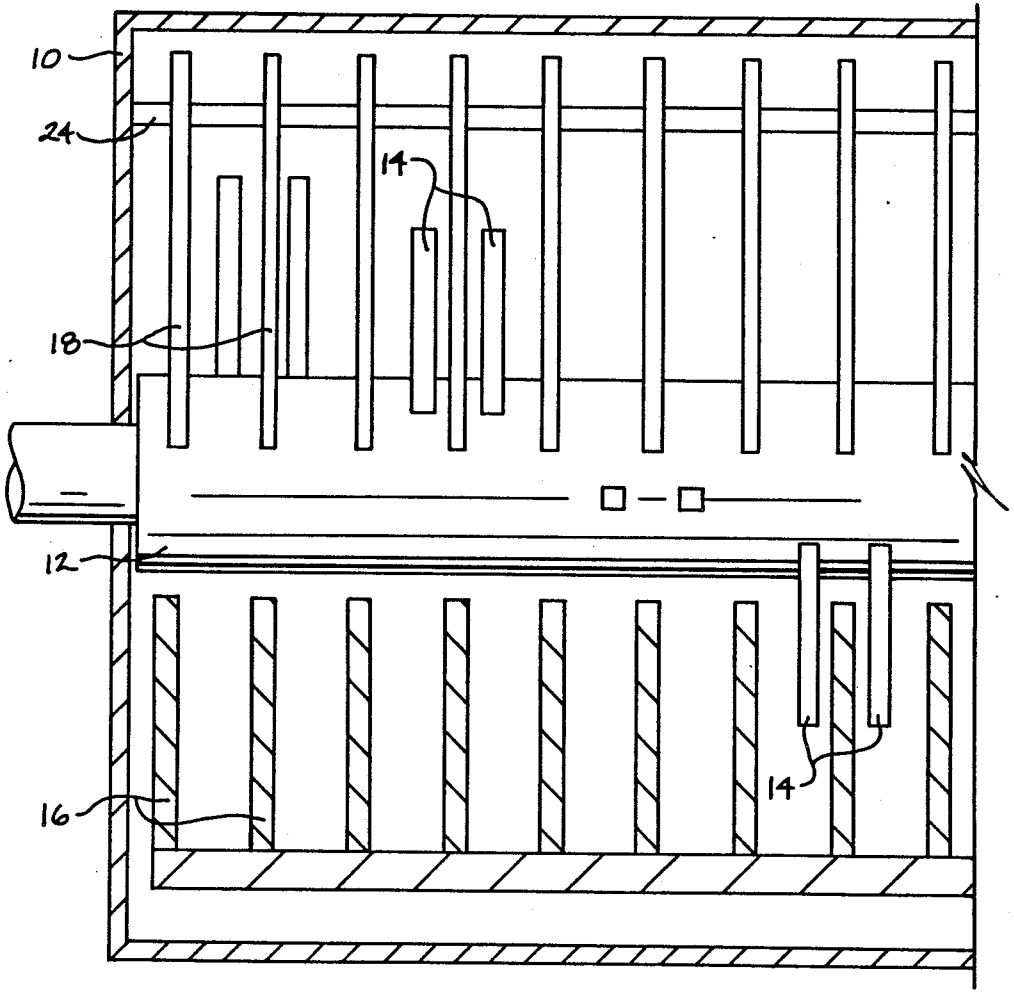
FIG. 2 is a schematic top plan view of a shredding unit provided in accordance with the present invention.
Figure 4:
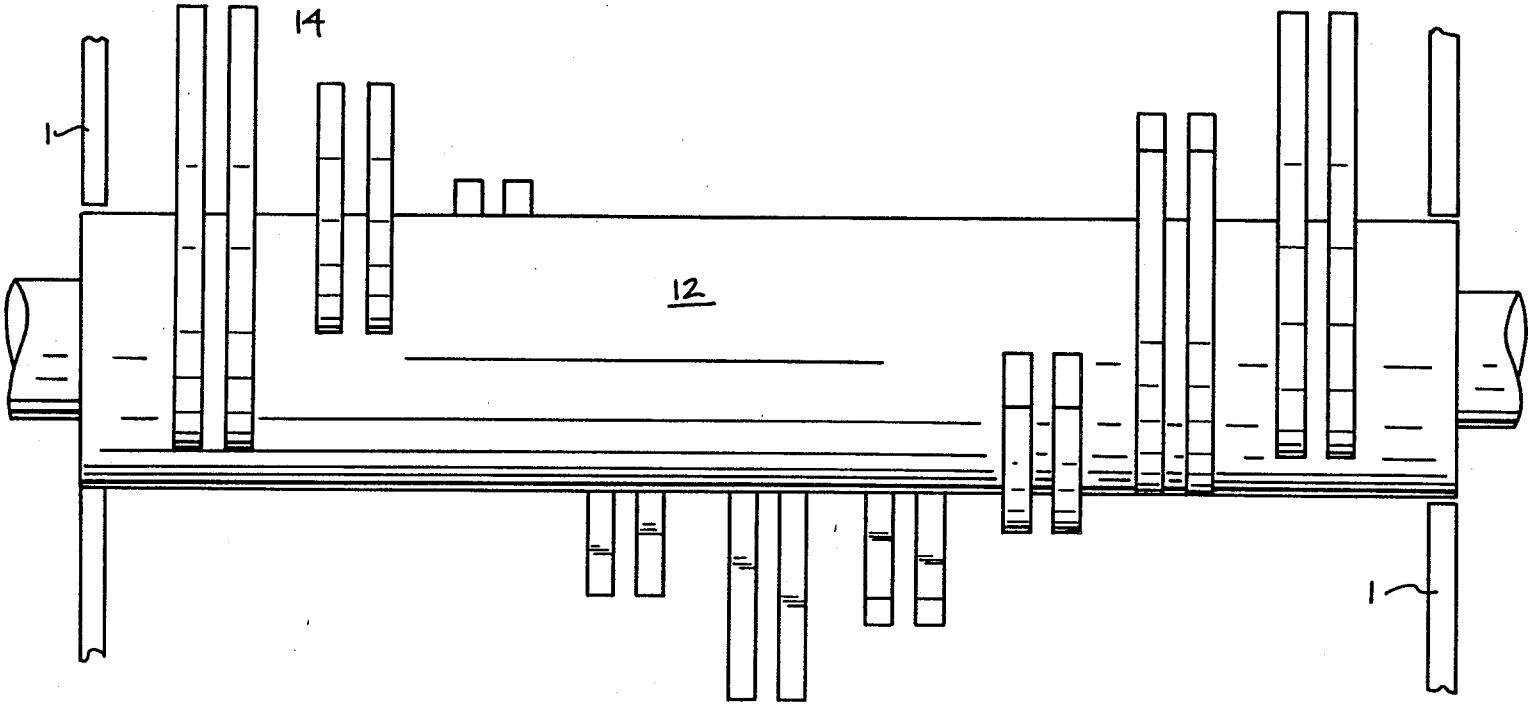
FIG. 4 is a schematic plan view showing the disposition of blades on the rotor.

Referring to FIGS. 2 and 4, blades 14 are formed integrally with the rotor 12 and consist of large wear resistant sheet steel which is very thick, approximately 80 millimeters, and each have a geometric shape such that they form a cutting angle with the counterblades 16 allowing a progressive effort without crashes. Thus, the shape of blades 14, as well as their disposition on the axis are so as to reduce the cutting effort as much as possible.

Indeed, while the concept of providing a helical disposition of blades 14 has been considered in prior apparatuses, in accordance with the present invention, the reciprocal shape of the blades 14 and the counterblades 16 has been specifically configured so as to have on each a perfectly straight cutting portion. This feature is of utmost importance in terms of maintenance cost. In particular, the materials used in accordance with the present invention are wear resistant with high performing characteristic and are not ductile at all. Therefore, the provision of straight sections instead of shaped ones allows much easier maintenance interventions. Thus, the machine of the invention, from the viewpoint of effort and wear reduction offers a peculiar characteristic which is not shared by other equipment.

Above, the radial and tangential forces have been considered which are more directly connected with the equipment torque. However, there are also other forces which stress the equipment members a great deal. These forces are the axial forces.

A cutting action always involves an axial thrust between blades and counterblades and the machine rotor must be designed so that the force can be reduced or annulled by an equal and opposite force. This important characteristic has been achieved by coupling blades 14 two by two in connection with each counterblade 16 so as to equal the distance from the same. In this manner, two almost equal but opposite forces are generated and annul one another. FIG. 2 shows this disposition.

Counterblades 16 are hinged on an axis 30 about which they can rotate. The counterblades are made of very thick (80 mm) wear resistant plate and can be linked as a block or mounted independent of one another. The counterblades 16 are kept in a predetermined position by one or more hydraulic cylinders 32 which are hinged on the counterblades 16 at a pivot point 34 and on the casing or housing 10 at a pivot point 36 as well as hydraulically connected to an accumulator (not shown in particular). Inside the accumulator there is an elastic tank for nitrogen or the like and this allows the hydraulic unit to perform a spring retraction when the pressure exerted on the counterblades 16 by the blades 14 exceeds an expected rate, and then return the counterblades to their original position.

The counterblades provided in accordance with the present invention are unique in their geometry and position with respect to the rotor 12 and blades 14. More particularly, with reference to FIGS. 1 and 3, the disposition of the counterblades 16 allows the blades 14 and counterblades 16 to be cleared from any clogging simply by means of a rotating movement. Indeed, the counterblades can quickly move backward when efforts exceed the established amounts. Thus, the rotor can run at a rotation speed of between 0 and 40 revolutions without the problems encountered with the U.S. Pat. No. '896 structure which can not exceed 15 to twenty revolutions per minute, and is able at the same time to run slowly enough to avoid a risk of explosion.

Actually, solid waste due to its elastic nature may need a great deal of room and time for falling down in the outlet hopper and quite often such waste can be dragged back again in the cycle by the blades thereby causing a reduction in machine throughput. Thus, another important characteristic of the present invention which results from the disposition of counterblades 16 as well as from their place inside the upper portion of the machine is the extreme ease with which the material can precipitate on the outlet mouth 38 below.

Figure 3:
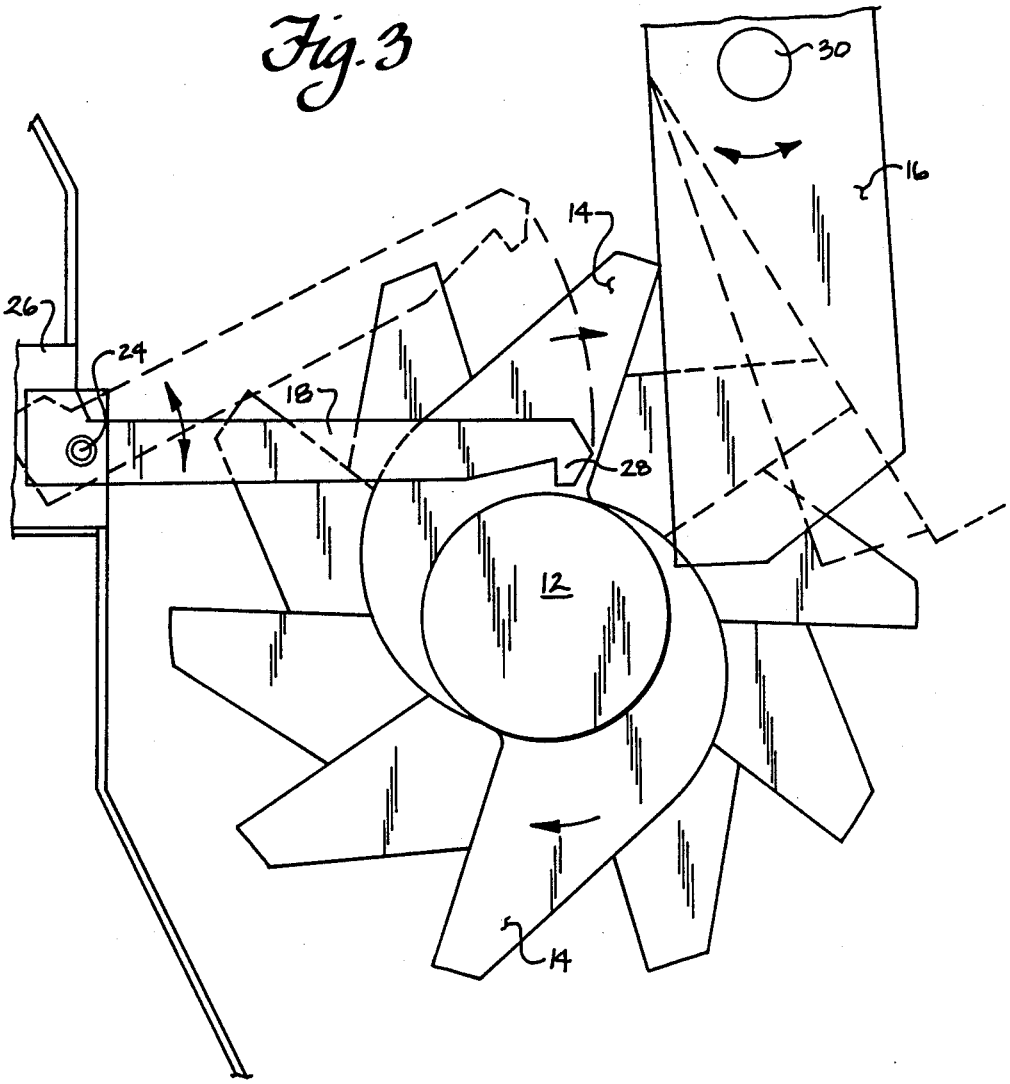
FIG. 3 is an enlarged, schematic detailed elevational view of the rotor blades, counterblades and screening cross members of the invention.

A further feature of the present invention is the provision of a means for rejecting unshreddable items of any kind without requiring the reverse in rotation of the rotor 12 and thus breaks in the production are avoided. As noted above, when the force on one or more counterblades 16 exceeds a predetermined amount, the counterblade(s) are retracted to allow passage of the unshreddable item. Further, in accordance with the present invention, a diverter 20 is provided which is controlled by impulses from the movement of counterblade(s) 16. Specifically, as the counterblades 16 move back under the influence of an unshreddable item, they give an impulse to a circuit (not shown in particular) which is either electric or mechanical and which controls a cylinder 40. Cylinder 40 is mounted to housing 10 and 42 and coupled to diverter 20 at 44. Movement of counterblade(s) 16 to the right as shown in FIGS. 1 and 3 activates cylinder 40 to extend and pivot diverter 20 about it pivotal mounting 46 to housing 10. Diverter 20 is disposed so that only a small rotation about its axis 46 is sufficient to activate diverter 20 to divert the unshreddable waste which falls thereon towards an alternative outlet 47. The combined action of the diverter and the rotor blades 14 projects the unshreddable items to the side which makes them fall down in dedicated discharge hopper 47. Because the shredded material normally has a great depth in which to fall due to the influences of gravity, as noted above, it will not be contacted by blades 14 and projected towards the dedicated discharge hopper 47. Indeed, only when the diverter 20 moves by rotating about its axis 46 so as to be brought closer to blades 14 do the rotating blades tend to drag and project the unshreddable item(s) into discharge hopper 47. When counterblade(s) 16 return to their operating position, diverter 20 returns to its inoperative disposition so that shredded refuse can properly fall through outlet hopper 38.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

What is claimed is:

1. An apparatus for processing solid refuse by breaking up refuse containers, reducing volume of oversized items and removing relatively nonshreddable items such as appliances, carpeting, tires and the like, which comprises:

a housing having an inlet for solid refuse, an outlet for shredded refuse, and an outlet for nonshreddable items;

a rotor rotatably mounted in said housing intermediate said inlet and said outlet;

a plurality of blades mounted to said rotor;

a plurality of counterblade elements mounted to said housing adjacent to said rotor and disposed for meshing with said blades for shredding solid refuse therebetween;

pre-screening means for screening relatively small, abrasive materials in solid refuse fed through said inlet prior to shredding of the solid refuse between said blades and said counterblade elements; and diverting means for diverting nonshreddable items towards said outlet for nonshreddable items in the solid refuse, said diverting means intercepting a fall path of nonshreddable items after their passage between said blades and said counterblades.

2. An apparatus as in claim 1, wherein said counterblade elements are mounted to said housing on a first side of a vertical plane through a longitudinal axis of said rotor and said inlet and said pre-screening means are provided on a second, opposite side of said vertical plane.

3. An apparatus as in claim 2, wherein said pre-screening means comprises a plurality of bar elements mounted to said housing so that the longitudinal axes thereof are disposed substantially perpendicular to a longitudinal axis of said rotor, said bars being spaced apart along the longitudinal axis of said rotor so as to define gaps therebetween for passage of said small, abrasive materials, each said bar element being pivotally mounted at a proximal end thereof to said housing and having a hook element provided on a distal end thereof, said bar elements being disposed so that said hook element skims along a vertically upper surface of said rotor, said hook elements defining a means for cleaning said rotor between said blades.

4. An apparatus as in claim 3, wherein said hook elements engage said rotor on said first side of said vertical plane.

5. An apparatus as in claim 2, wherein said counterblade elements are pivotally mounted to said housing and further including at least one hydraulic cylinder mounted to said counterblade elements for retracting said counterblades when a force greater than a predetermined force is exerted on said counterblades so that said counterblades pivot out of position when contacted by a non-shreddable item.

6. An apparatus as in claim 5, wherein said diverting means includes a diverter element operatively coupled to said counterblades and pivotally coupled to said housing so as to move into the path of a non-shreddable item which has contacted and effected the motion of a counterblade, said rotor blades in cooperation with said diverter element directing said non-shreddable refuse toward said outlet for non-shreddable items.

7. An apparatus as in claim 1, wherein said pre-screening means comprise a plurality of bar elements mounted to said housing so that the longitudinal axes thereof are disposed substantially perpendicular to a longitudinal axis of said rotor, said bars being spaced apart along the longitudinal axis of said rotor so as to define gaps therebetween for passage of said small, abrasive materials.

8. An apparatus as in claim 1, further comprising means for cleaning said rotor between said blades.

9. An apparatus as in claim 8, wherein said pre-screening means, include said means for cleaning.

10. An apparatus as in claim 1, wherein said pre-screening means comprises a plurality of bar elements mounted to said housing so that the longitudinal axes thereof are disposed substantially perpendicular to a longitudinal axis of said rotor, said bars being spaced apart along the longitudinal axis of said rotor so as to define gaps therebetween for passage of said small, abrasive materials, each said bar element being pivotally mounted at a proximal end thereof to said housing and having a hook element provided on a distal end thereof, said bar elements being disposed so that said hook element skims along a vertically upper surface of said rotor, said hook elements defining a means for cleaning said rotor between said blades.

11. An apparatus as in claim 1, wherein said counterblade elements are pivotally mounted to said housing and further including at least one hydraulic cylinder mounted to said counterblade elements for retracting said counterblades when a force greater than a predetermined force is exerted on said counterblades so that said counterblades pivot out of position when contacted by a non-shreddable item.

12. An apparatus as in claim 11, further comprising a diverter element operatively coupled to said counterblades and pivotally coupled to said housing so as to move into the path of a non-shreddable item which has contacted and effected the motion of a counterblade, said rotor blades in cooperation with said diverter element directing said non-shreddable refuse toward said outlet for non-shreddable items.

13. An apparatus as in claim 1, wherein said rotor blades are mounted so as to define a helix of blades along said rotor.

14. An apparatus as in claim 1, wherein said blades are mounted to said rotor in pairs, said pairs of blades being mounted to said rotor so as to define a helix of pairs of blades along said rotor.

15. An apparatus as in claim 14, wherein said counterblades are mounted so that each counterblade cooperates with a pair of blades.

16. An apparatus for processing solid refuse which comprises:

a housing having an inlet for solid refuse, an outlet for shredded refuse, and an outlet for nonshreddable items;

a rotor rotatably mounted in said housing intermediate said inlet and outlet;

a plurality of blades mounted to said rotor;

a plurality of counterblade elements pivotally mounted to said housing adjacent said rotor and disposed for cooperating with said blades for shredding solid refuse therebetween, said counterblade elements pivoting out of position when a force greater than a predetermined force is exerted thereon so as to allow nonshreddable items to pass thereby;

pre-screening means for screening relatively small, abrasive materials in solid refuse fed through said inlet prior to shredding of the solid refuse between said blades and said counterblade elements; and diverting means for diverting nonshreddable items towards said outlet for nonshreddable items, said diverting means intercepting a fall path of nonshreddable items after their passage between said blades and said counterblades, said diverting means including a diverting element operatively coupled to said counterblade elements and pivotally coupled to said housing so as to move into the path of a nonshreddable item which has contacted and effected motion of a counterblade element, said rotor blades in cooperation with said diverter element directing said nonshreddable refuse towards said outlet for nonshreddable items.

17. An apparatus for processing solid refuse which comprises:

a housing having an inlet for solid refuse, an outlet for shredded refuse, and an outlet for nonshreddable items;

a rotor rotatably mounted in said housing intermediate said inlet and outlet;

a plurality of blades mounted to said rotor;

a plurality of counterblade elements mounted to said housing adjacent to said rotor and disposed for cooperating with said blades for shredding solid refuse therebetween;

pre-screening means for screening relatively small, abrasive materials in solid refuse fed through said inlet prior to shredding of the solid refuse between said blades and said counterblade elements, said pre-screening means comprising a plurality of bar elements mounted to said housing so that the longitudinal axes thereof are disposed substantially perpendicular to a longitudinal axis of said rotor, said bars being spaced apart along the longitudinal axis of said rotor so as to define gaps therebetween for passage of said small, abrasive materials, each said bar element being pivotally mounted at a proximal end thereof to said housing, at least some of said blades mounted to said rotor passing between adjacent bar elements of said pre-screening means as said rotor rotates; and diverting means for diverting nonshreddable items towards said outlet for nonshreddable items, said diverting means intercepting a fall path of nonshreddable items after their passage between said blades and said counterblades.

* * * * *